United States Patent [19]

Szczesny et al.

[11] Patent Number: 4,693,533

[45] **Date of Patent: * Sep. 15, 1987**

[54] RIBBON CABLE CONNECTOR WITH IMPROVED COVER LATCH

[75] Inventors: David S. Szczesny, Harrisburg; John A. Root, Middletown, both of Pa.

[73] Assignee: AMP Incorporated, Harrisburg, Pa.

[ * ] Notice: The portion of the term of this patent subsequent to Nov. 11, 2003 has been disclaimed.

[21] Appl. No.: 878,766

[22] Filed: Jun. 26, 1986

Related U.S. Application Data

[63] Continuation-in-part of Ser. No. 778,095, Sep. 20, 1985, Pat. No. 4,621,885.

[51] Int. Cl.[4] ..... H01R 4/24; H01R 13/627

[52] U.S. Cl. ..... 439/350; 439/404

[58] Field of Search ..... 339/91 R, 97 R, 97 P, 339/98, 99 R, 103 M, 17 F, 176 MF

[56] References Cited

U.S. PATENT DOCUMENTS

| | | | |
|---|---|---|---|
| 4,188,083 | 2/1980 | Knowles | 339/99 R |
| 4,431,248 | 2/1984 | Huntley et al. | 339/99 R |
| 4,452,501 | 6/1984 | Gladd et al. | 339/97 R |
| 4,579,414 | 4/1986 | Caveney et al. | 339/99 R |
| 4,619,493 | 10/1986 | Kikuta | 339/91 R |

FOREIGN PATENT DOCUMENTS

| | | | |
|---|---|---|---|
| 2358895 | 6/1974 | Fed. Rep. of Germany | 339/91 R |

OTHER PUBLICATIONS

"Spring Retainer", IBM Bulletin, vol. 16, No. 12, May 1974, by R. T. Evans.

"Connector Retention and Polarizing Clip", IBM Bulletin, vol. 28, No. 5, Oct. 1985.

*Primary Examiner*—Gil Weidenfeld

*Assistant Examiner*—Gary F. Paumen

*Attorney, Agent, or Firm*—Bruce J. Wolstoncroft; David L. Smith

[57] ABSTRACT

Ribbon cable connector has latch members fixed to cover at opposite ends thereof. Each latch member is U-shaped, having first and second latch arms and a formed bight therebetween. The first arm has projections cooperable with web means on the end of the connector housing and cover which permits the cover to be moved between a first and second position and secured therein. The second arm at its distal end is formed with an outwardly directed hook cooperable with a complementary connector.

15 Claims, 8 Drawing Figures

140
138
136
130
106
126
122
132
4
124
144
6
128
108
104
102
112
110
142
114
146

138
136
130
144
106
104
122
4
132
126
6
124
128
108
102
142
110
112
114
146

RIBBON CABLE CONNECTOR WITH IMPROVED COVER LATCH

This application is a continuation-in-part of U.S. application Ser. No. 778,095 filed Sept. 20, 1985, now U.S. Pat. No. 4,621,885.

BACKGROUND OF THE INVENTION

The present invention relates to a dual position latch for preassembling the cover to the housing of a ribbon cable connector, and further for retaining a complementary connector.

U.S. Pat. No. 4,359,257 discloses a ribbon cable connector of the type comprising an elongate housing with insulation displacing contacts projecting from the top surface thereof and an elongate cover having aperture means therein for receiving the contacts. Latch means at opposite ends of the connector fix the cover in first and second latched positions relative to the housing, the cover being spaced from the top surface in the first position to permit alignment of the cable for termination. The cover is movable from the first position toward the top surface to terminate the cable, the cover securing the cable in a terminated condition at the second position.

The connector as described above employs a pair of parallel latch arms molded integrally with the cover at opposite ends thereof. Detents on each latch cooperate with a yoke on the housing at the first position, and each latch arm is U-shaped to snap over a detent on the housing at the second position. A similar arrangement employing detents only on the latch arms is disclosed in U.S. Pat. No. 4,496,207.

The above-described arrangement is satisfactory for achieving a "preassembled" connector which facilitates handling and ease in aligning a ribbon cable for termination. Any latching to a complementary connector has heretofore been achieved by discrete latching members. In particular, when the complementary connector is a header fixed to a printed circuit board, resilient latch arms are provided on the header. However, the advent of surface mount technology has necessitated the use of more brittle plastics which will withstand soldering temperatures. It is thus desirable to fix the resilient latch arms to the ribbon cable connector.

SUMMARY OF THE INVENTION

According to the invention, therefore, a ribbon cable connector as described above is characterized in that the latch means comprises a pair of stamped and formed metal latch members fixed to the cover at respective opposite ends thereof. Each latch member has a first latch arm cooperable with the respective end of the housing to effect latching at the first and second positions and a second latch arm adjacent the first latch arm and spaced from the housing. The second latch arm cooperates with a complementary connector to retain the ribbon cable connector thereto.

The invention further comprises first means provided on the latching member and the cover to secure them together enabling the cover and the latch member to move as one piece. Second means are also provided on the first latch arm to allow movement of the latch member between the first position and the second position, securing the latch member in the second position as required.

Not only do the latch arms combine several latching functions, but the use of spring metal makes the latch arms less subject to damage than the plastic heretofore used. While U.S. Pat. No. 4,431,248 discloses metal latch arms fixed in a housing to achieve preassembly of a cover, the additional function of providing retention to a complementary connector is not suggested.

DETAILED DESCRIPTION OF THE PREFERRED EMBODIMENT

Figure 1:
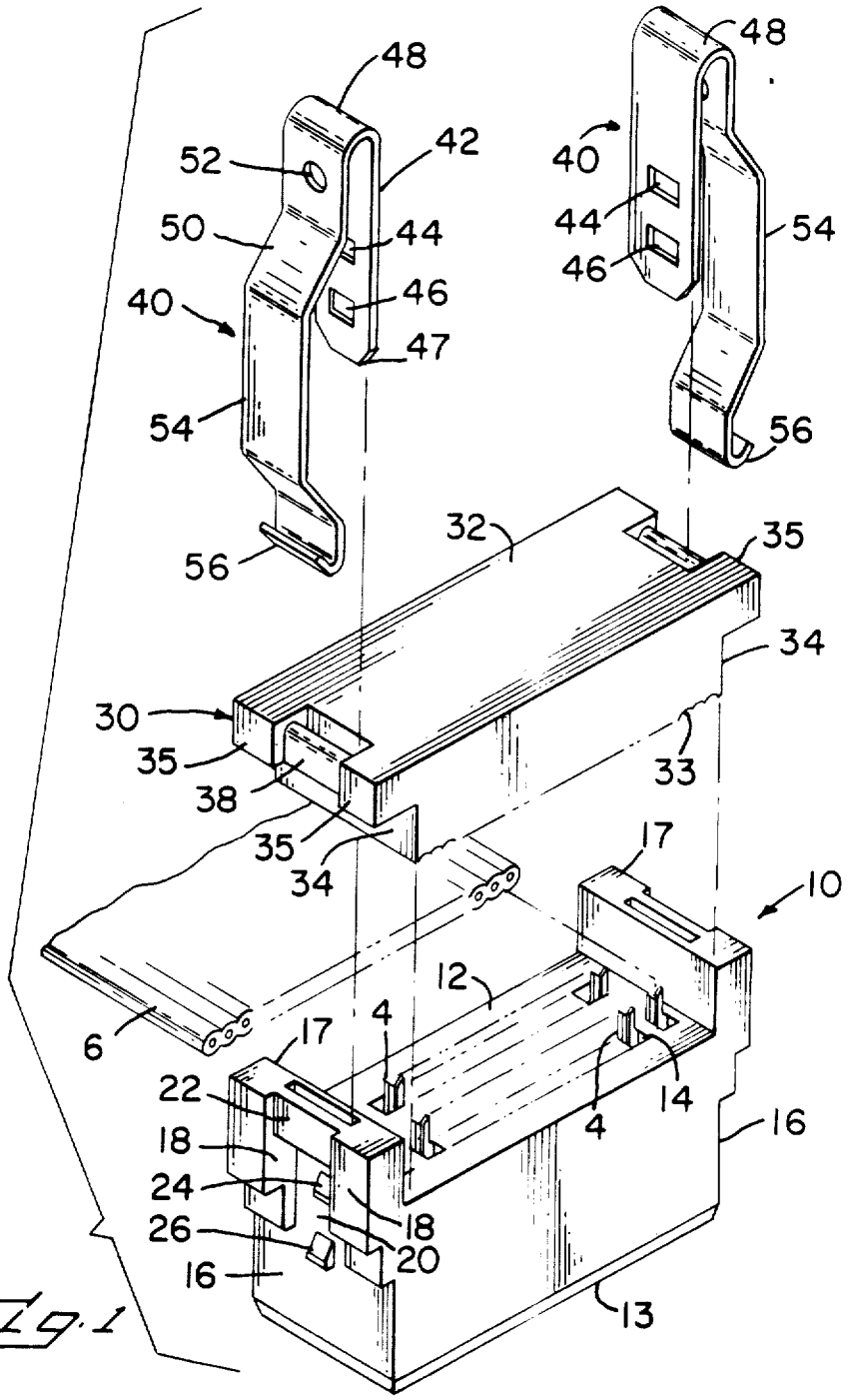
FIG. 1 is an exploded perspective of the connector.

Referring to FIG. 1, the connector comprises a molded dielectric housing 10 having a top surface 12, an opposed bottom surface 13, and a plurality of contact receiving passages 14 extending therebetween, the slotted plate portions of contacts 4 extending above surface 12. The housing 10 has opposed endwalls 16 with upstanding portions 17 flanking the surface 12 therebetween. Each endwall 16 has parallel sidewalls 18 thereon defining a channel 20 therebetween and a web 22 extending between sidewalls 18 on the upstanding portion 17. First and second detents 24, 26 lie in channel 20 and serve a latching function as will be described. The cover 30 has a top surface 32, a fluted bottom surface 33, and opposed ends 34. Each end 34 has a pair of extensions 35 thereon defining a channel 36 therebetween, and a web 38 bridging between the extensions. The latch member 40 is stamped and formed from spring metal such as stainless steel and comprises first and second latch arms 42, 50 connected by a bight 48 to yield a generally U-shaped profile. The first latch arm 42 has first and second apertures 44, 46 punched therethrough between the bight 48 and distal end 47. The second latch arm 50 has an outwardly formed hook 56 at its distal end and a bow 54 formed between the bight 48 and hook 56. A round hole 52 punched in arm 50 near bight 48 serves to retain a wire strain relief clip.

Figure 2:
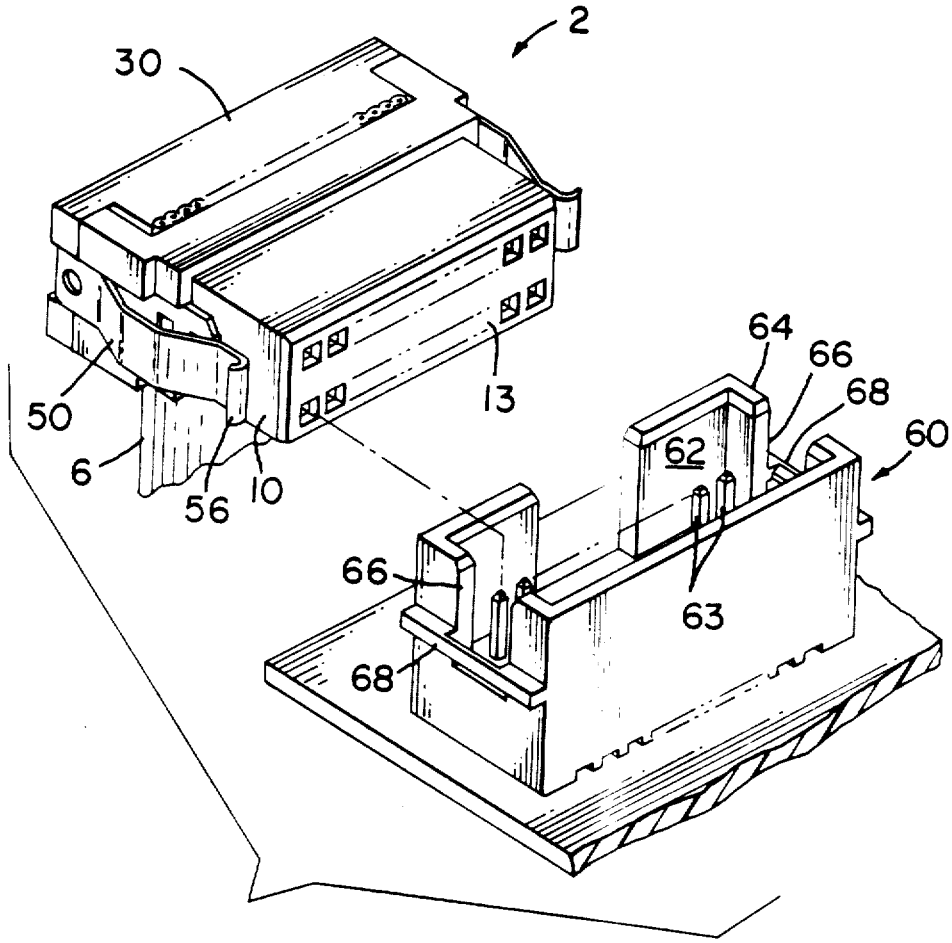
FIG. 2 is a perspective of the assembled connector exploded from a complementary connector.

Referring to FIG. 2, the assembled connector 2 is shown terminated to a ribbon cable 6, ready for mating to a pin header 60. The header 60 comprises a cavity 62 with an array of pins 63 therein, which pins 63 are received through bottom surface 13 of connector housing 10. The cavity 62 is bounded by endwalls 64 having respective channels 66 therein, each channel 66 being bridged by a yoke 68. The channels 66 allow latch arms 50 to flex inward during mating until the hooks 56 engage respective yokes 68 to retain the connector 2 to header 60.

Figure 3:
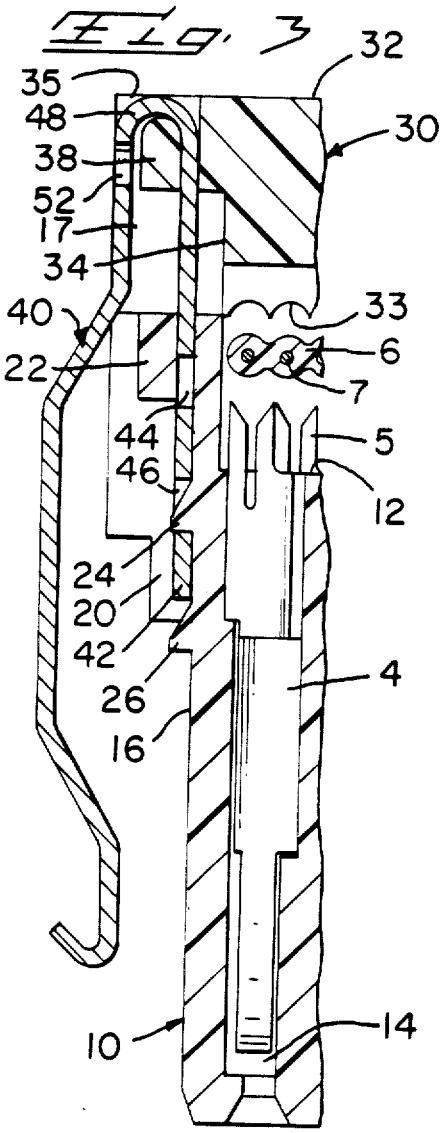
FIG. 3 is a partial side section of the preassembled connector.

FIG. 3 shows cover 30 preassembled to housing 10; here the lower or second aperture 46 in each first arm 42 is engaged with the upper or first detent 24 on the endwall 16. The latch member 40 is press fit into cover 30 between extensions 35 until the bight 48 rests on web 38. Arm 42 is closely received in channel 20 to provide lateral stability, while the fit of cover ends 34 between uprights 17 lends longitudinal stability. The web 22 between sidewalls 18 serves to increase the spring force necessary to deflect the arm 42 away from endwall 16.

To terminate a ribbon cable, the preassembled connector of FIG. 3 is placed upside-down with the top surface 32 on an anvil. The ribbon cable is aligned on fluted bottom surface 33, and a press is brought to bear on bottom surface 13 of the housing 10. This advances top surface 12 downward so that slotted plates 5 engage individual conductors 1 in the cable. The first latch arms 42 flex away from adjacent endwalls 16 as the aperture 45 rides up the ramped upper surface of first detent 24; the arms 42 continue to flex until first aperture 44 engages first detent 24 and second aperture 46 engages second detent 26, as shown in FIG. 4.

Figure 4:
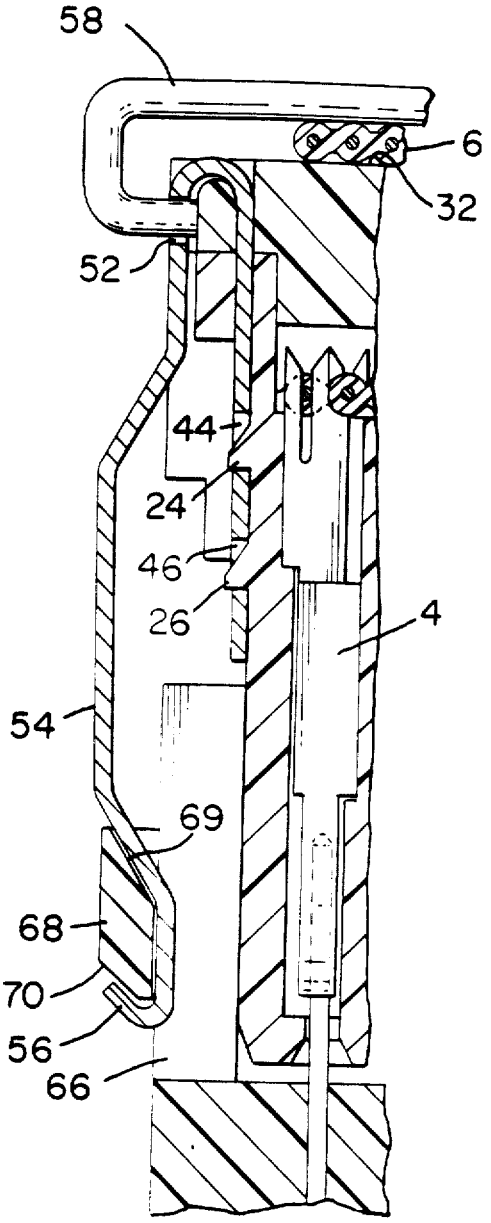
FIG. 4 is a partial side section of the assembled connector latched to a complementary connector.
Figure 5:
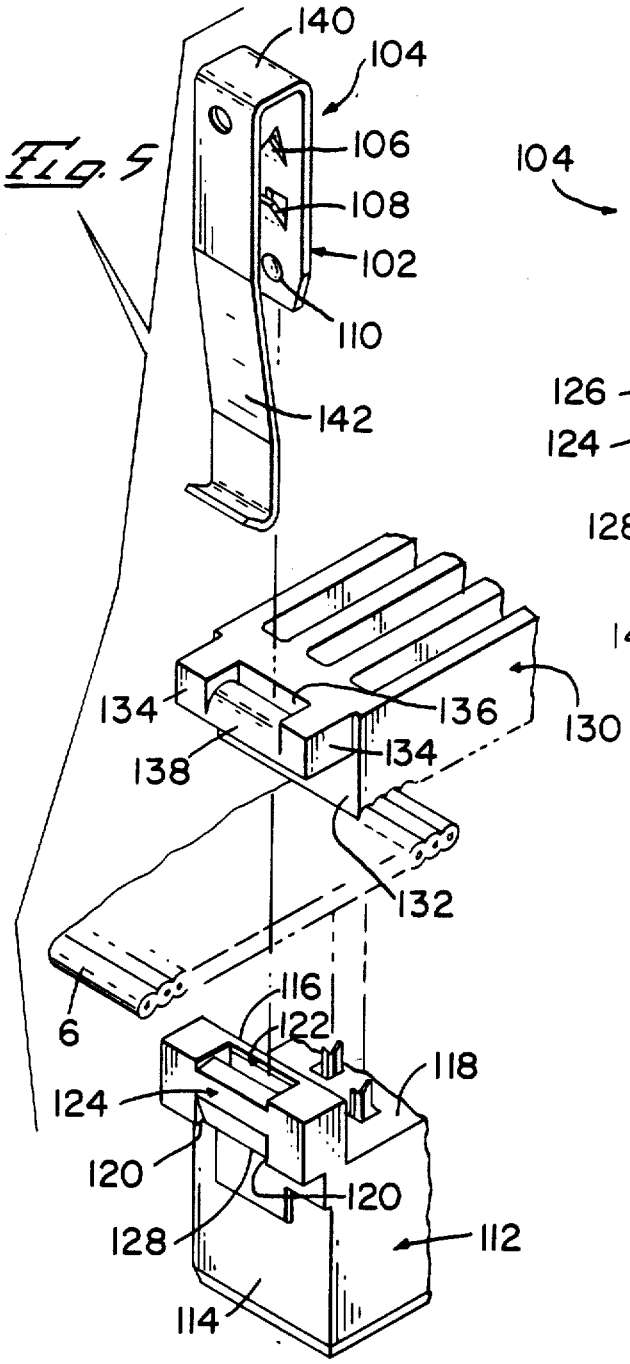
FIG. 5 is a partial exploded perspective of the connector showing an alternative connector.

FIG. 4 depicts a fully assembled connector 2, also shown in FIG. 2, as mated to pin header 60. The hook 56 is formed to ride against ramped upper surface 69 of yoke 68 during mating. To release the connector 2, the bowed portions 54 at opposite ends are depressed so that the hooks 56 ride against ramped lower surfaces 70 of yokes 68 until the hooks 56 snap off of respective yokes. An optional strain relief wire 58, used to clamp the ribbon cable against top surface 32, is shown hooked in punched hole 52.

An alternative embodiment of the invention is shown in FIGS. 5 through 8. First latch arm 102 of each latch member 104 has a triangular projection 106, a square projection 108, and an embossment 110 extending away from dielectric housing 112. Each sidewall 114 of housing 112 has an upstanding portion 116 flanking a surface 118 of housing 112. Each endwall 114 has parallel sidewalls 120 thereon defining a channel 122 therebetween and a web 124 extending between sidewalls 120 on the upstanding portion 116. Web 124 has sloping surface 126 and straight surface 128 which cooperate with projection 108 to hold a cover 130 in various positions with respect to housing 112. Each end 132 of cover 130 has a pair of extensions 134 thereon defining a channel 136 therebetween and a web 138 bridging between the extensions.

Figure 6:
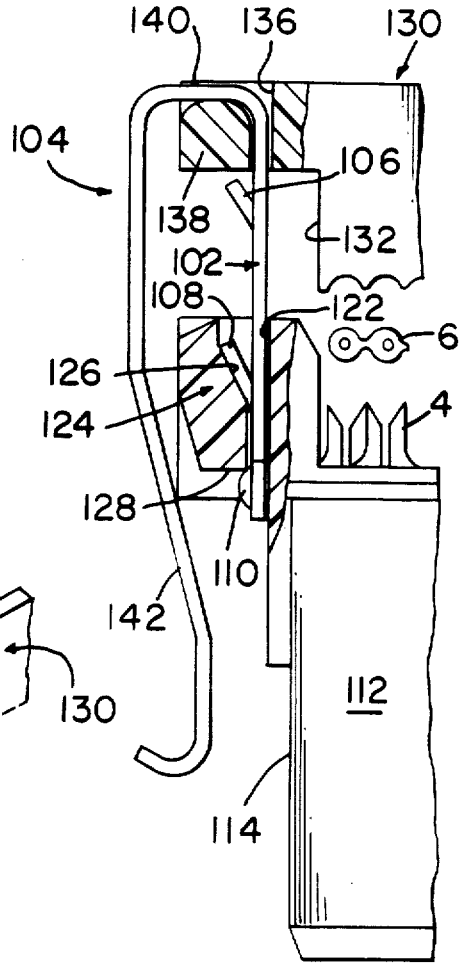
FIG. 6 is a partial side section of the preassembled connector showing the alternative connector.

FIG. 6 shows cover 130 preassembled to housing 112. The embossment 110 of each first arm 102 is in contact with a bottom portion of web 124 while projection 108 engages surface 126 of web 124. At the same time, projection 106 engages a bottom of web 138 while a bight 140 of latch member 104 engages an arcuate top of web 138. This configuration secures cover 130 in the position shown until external force is applied.

Figure 7:
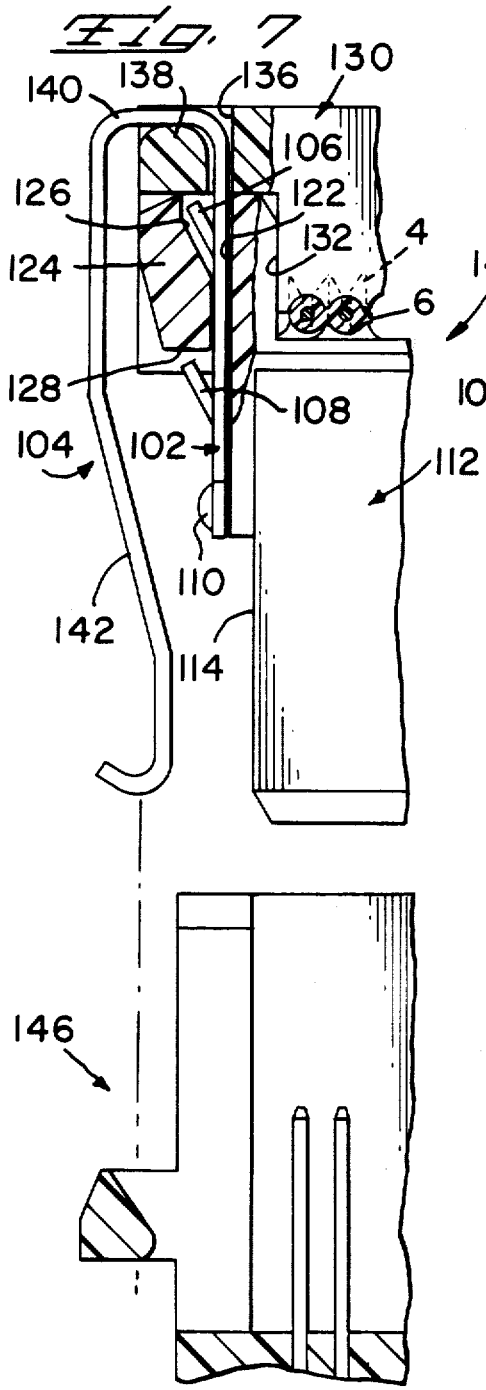
FIG. 7 is a partial side section similar to FIG. 6 of the assembled connector.

The method of termination is the same as previously described. As termination occurs, projection 108 flexes inward as latch member 104 is forced to move under the control of cover 130 which moves relative to housing 112 to terminate the conductors of cable 6 to respective terminating sections of electrical terminals 4 in housing 112. Projection 108 continues to flex until projection 108 moves past web 124. At this point, projection 108 returns to an unstressed position as projection 106 engages surface 128 of web 124. Cover 130 is now in a latched position because projection 108 is in alignment with web 124 and projection 106 remains in alignment with web 138. The fully assembled connector 144 is shown in FIG. 7.

Figure 8:
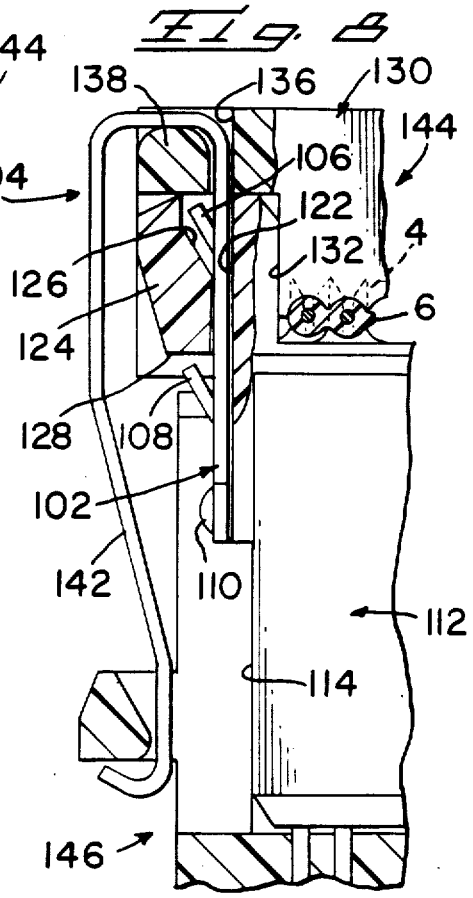
FIG. 8 is a partial side section similar to FIG. 5 of the assembled connector latched to a complementary connector.

FIG. 8 shows the fully assembled connector 144 mated to the pin header 146 as described earlier. The shape of second latch arm 142 of latch member 104 varies slightly from that previously shown but operates in the same manner thereby latching connectors 144, 146 together so as to be electrically connected together. All parts not specifically mentioned in this alternative embodiment behave as previously described.

The foregoing is exemplary and not intended to limit the scope of the claims which follow.

We claim:

1. A ribbon cable connector of the type comprising a housing with insulation displacing contacts projecting from a top surface thereof, a cover having aperture means therein for receiving the contacts, and latch means at opposite ends of the connector effective to fix the cover in first and second latched positions relative to the housing, the cover being spaced from the top surface in the first position to permit alignment of the cable for termination, the cover being movable from the first position toward the top surface to terminate the cable, the cover securing the cable in terminated condition at the second position, the latch means comprises a pair of latch members fixed to the cover at respective opposite ends thereof, each latch member having a first latch arm cooperable with respective ends of the housing to effect latching at the first and second positions, each latch member further comprising a second latch arm adjacent the first latch arm and spaced from the housing, the second latch arms being cooperable with a complementary connector to retain the ribbon cable connector thereto, the connector being characterized in that:

first means are provided by the cover and the latch members securing the cover and latch members together, and as the cover is moved between the first position and the second position, the latch members move accordingly, the cover and the latch members being secured together by the first means; and second means are provided by the first latch arms and the housing such that as the cover is moved between the first position and the second position, the latch member is permitted to move accordingly, as the second position is reached the second means secures the cover in the second position.

2. A ribbon cable connector as claimed in claim 1 wherein each latch member is formed with a bight where the latch member is formed through about one hundred eighty degrees between the first and second latch arms.

3. A ribbon cable connector as claimed in claim 2 wherein the first means are provided adjacent each bight and comprise a pair of extensions extending from the cover, a web extending transversely therebetween and a resilient first projection on the first latch arm, the bight and the first projection are positioned on opposed sides of the web and cooperate to secure the cover to the latch member.

4. A ribbon cable connector as claimed in claim 1 wherein the second means comprises a pair of extensions extending from each end of the housing, a web extending transversely therebetween, an embossment and resilient first and second projections on the first latch arm, the first projection and embossment are positioned on opposed sides of the web with the cover disposed in the first position, and with the cover disposed in the second position, the first projection and the embossment are positioned on the same side of the web with the second projection positioned on the opposite side of the web, the first and second projections engage the respective sides of the web securing the cover to the housing.

5. A ribbon cable connector as claimed in claim 1 wherein each second latch arm has an outwardly formed hook remote from said cover, said complementary connector having a web at each end, each hook latching to a respective web when the ribbon cable connector is mated to the complementary connector.

6. A ribbon cable connector as claimed in claim 5 wherein each second latch arm is formed with a bow between the cover and the hook, each bow being depressed toward the housing to release the hook from the respective web on the complementary connector.

7. A ribbon cable connector as claimed in claim 1 wherein said second latch arms are stamped with holes adjacent said cover, said holes serving to anchor a wire strain relief clip for holding the ribbon cable against the cover.

8. An electrical connector for electrical connection to electrical conductors of a ribbon cable and for latchable engagement with a complementary electrical connector, comprising:

a dielectric housing member having electrical terminals secured therein, said electrical terminals having terminating sections extending above an upper surface of said housing member;

a cover member;

latching members having first latch arm means and second latch arm means;

first means provided by said cover member and said latching members securing said latching members to respective ends of said cover member;

second means provided by said housing member and said second latch arm means of said latching members maintaining said cover member in an upper position spaced from said upper surface of said housing member so that the ribbon cable can be positioned between the cover member and the upper surface of the housing member; and third means provided by said housing member and said second latch arm means of said latching members maintaining said cover member in a down position in engagement with the ribbon cable after the cover member and housing member have been moved toward each other with the terminating sections of the electrical terminals terminated to respective electrical conductors of the ribbon cable.

9. An electrical connector as recited in claim 8 wherein each latch member is formed with a bight where the latch member is formed through about one hundred eighty degrees between the first and second latch arms.

10. An electrical connector as recited in claim 9 wherein the first means are provided adjacent each bight and comprise a pair of extensions extending from the cover, a web extending transversely therebetween and a resilient first projection on the first latch arm, the bight and the first projection being positioned on opposed sides of the web and cooperate to secure the cover to the latch member.

11. An electrical connector as recited in claim 8 wherein the second means comprises a pair of extensions extending from each end of the housing, a web extending transversely therebetween, a resilient first projection on the first latch arm and an embossment on the first latch arm, the projection and embossment are positioned on opposed sides of the web in the upper position.

12. An electrical connector as recited in claim 11 further comprising a second resilient projection on the first latch arm wherein the third means has the first projection and the embossment positioned on the same side of the web with the second projection positioned on the opposite side of the web in the down position, the first and second projections engage the respective side of the web securing the cover to the housing.

13. An electrical connector as recited in claim 8 wherein each second latch arm means has an outwardly formed hook remote from said cover, said complementary electrical connector having a web at each end, each hook latching to a respective web when the electrical connector is mated to the complementary electrical connector.

14. An electrical connector as recited in claim 13 wherein each second latch arm means is formed with a bow between the cover and the hook, each bow being depressed toward the housing to release the hook from the respective web on the complementary electrical connector.

15. An electrical connector as recited in claim 8 wherein said second latch arms are stamped with holes adjacent said cover, said holes serving to anchor a wire strain relief clip for holding the ribbon cable against the cover.

* * * * *

UNITED STATES PATENT AND TRADEMARK OFFICE

CERTIFICATE OF CORRECTION

PATENT NO. : 4,693,533

DATED : September 15, 1987

INVENTOR(S) : David Stanley Szczesny et al.

It is certified that error appears in the above-identified patent and that said Letters Patent is hereby corrected as shown below:

Column 4, line 23, "comprises" should read -- comprising --.

Signed and Sealed this

Fifth Day of July, 1988

*Attest:*

DONALD J. QUIGG

*Attesting Officer*

*Commissioner of Patents and Trademarks*